US009095763B2

(12) United States Patent
Sternberg

(10) Patent No.: US 9,095,763 B2
(45) Date of Patent: Aug. 4, 2015

(54) METHOD AND MIXTURE FOR FOUNDATION OF A SPORTS AREA

(75) Inventor: Martin Sternberg, Gothenberg (SE)

(73) Assignee: CAPILLARY CONCRETE AB, Moelndal (SE)

( * ) Notice: Subject to any disclaimer, the term of this patent is extended or adjusted under 35 U.S.C. 154(b) by 147 days.

(21) Appl. No.: 13/822,799

(22) PCT Filed: Sep. 5, 2011

(86) PCT No.: PCT/SE2011/051066
§ 371 (c)(1),
(2), (4) Date: Apr. 3, 2013

(87) PCT Pub. No.: WO2012/036612
PCT Pub. Date: Mar. 22, 2012

(65) Prior Publication Data

US 2013/0184090 A1 Jul. 18, 2013

Related U.S. Application Data

(60) Provisional application No. 61/383,815, filed on Sep. 17, 2010.

(51) Int. Cl.

| | |
|---|---|
| ***A63C 19/00*** | (2006.01) |
| ***E01C 7/14*** | (2006.01) |
| ***E01C 13/02*** | (2006.01) |
| ***A63B 69/36*** | (2006.01) |

(52) U.S. Cl.
CPC ..... *A63C 19/00* (2013.01); *A63B 69/3691* (2013.01); *E01C 7/142* (2013.01); *E01C 13/02* (2013.01)

(58) Field of Classification Search
None
See application file for complete search history.

(56) References Cited

U.S. PATENT DOCUMENTS

| | | | |
|---|---|---|---|
| 1,906,494 | A | 5/1933 | Steward |
| 2,026,052 | A | 12/1935 | MacLeod |
| 7,114,877 | B2 | 10/2006 | Wilkerson |
| 7,699,562 | B2 | 4/2010 | Clark |
| 2003/0082004 | A1 | 5/2003 | Wilkerson |
| 2003/0118403 | A1 | 6/2003 | Wilkerson |
| 2006/0051161 | A1 | 3/2006 | Benson |
| 2007/0278142 | A1 | 12/2007 | Clark |
| 2008/0292865 | A1 | 11/2008 | Ball et al. |
| 2010/0093454 | A1 | 4/2010 | Ball et al. |

FOREIGN PATENT DOCUMENTS

| | | | | |
|---|---|---|---|---|
| CN | 1853016 | A | | 10/2006 |
| GB | 2 245 132 | A | * | 1/1992 |
| GB | 2245132 | A | | 1/1992 |
| JP | H05-272109 | A | | 10/1993 |
| WO | WO-2005026442 | A1 | | 3/2005 |
| WO | WO-2007070913 | A1 | | 6/2007 |

OTHER PUBLICATIONS

International Search Report PCT/ISA/210 for International Application No. PCT/SE2011/051066 dated Apr. 1, 2012.

* cited by examiner

*Primary Examiner* — William Phillip Fletcher, III
(74) *Attorney, Agent, or Firm* — Harness, Dickey & Pierce, P.L.C.

(57) ABSTRACT

A method is disclosed, including providing a first mixture of cement and particulate stone material; mixing the first mixture with a predetermined amount of water for forming a second mixture; applying a layer of the second mixture to a surface located at the place where the sports area is intended to be situated; curing/setting the layer of the second mixture applied to the surface, wherein the cured layer is porous and allows water to flow through the cured layer; and applying a layer of a particle size fraction onto the cured layer after the step of curing. A mixture is also disclosed including cement and particulate stone material, wherein the mixture comprises ca. 15-40% by dry weight cement and 60-85% by dry weight particulate stone material, and wherein at least 75% of the particles of the particulate stone material are of sizes within the range 0.1-10 mm.

36 Claims, 4 Drawing Sheets

Particle size analysis:

| Free mesh size | Remains | | Passes | Remains |
|---|---|---|---|---|
| | gram | % | Σ % | Σ % |
| 11,2 | 0 | 0,00 | | 0 |
| 8 | 0 | 0,00 | | 0,00 |
| 5,6 | 0 | 0,00 | 100,0 | 0,0 |
| 4 | 1,2 | 0,21 | 99,8 | 0,2 |
| 2 | 135,3 | 23,31 | 76,5 | 0,2 |
| 1 | 295,4 | 50,89 | 25,6 | 74,4 |
| 0,6 | 139,2 | 23,98 | 1,6 | 98,4 |
| 0,2 | 9,1 | 1,57 | 0,1 | 99,9 |
| 0,125 | 0,2 | 0,03 | 0,0 | 50 |
| 0,075 | 0,1 | 0,02 | 0,0 | |
| <0,075 | 0 | 0,00 | 0,0 | |
| Sum | 580,5 | 100,00 | | |

METHOD AND MIXTURE FOR FOUNDATION OF A SPORTS AREA

FIELD OF THE INVENTION

The present invention relates to a method and a mixture for foundation of a sports area. In particular, the present invention relates to a method and a mixture for foundation of a golf bunker.

BACKGROUND OF THE INVENTION

Contamination of sand by the base soil and the shifting of bunker sand during rain events in golf bunkers are widely known problems. Golfers generally prefer thinner layers of sand in bunkers as it increases the chance of executing a good shot out of the bunker. Therefore, a thin layer of sand in a bunker is preferable. In addition, when a bunker is constructed, a thin layer of sand is less expensive to apply on the surface of the bunker than a thick layer, since the total volume of sand that is needed is smaller for such a thin layer. However, a thin layer of sand is more susceptible to be mixed with the underlying soil. Moreover, a thin layer of sand has poorer drainage property than a thick layer of sand, which may result in water and sand accumulating at the bottom of the bunker after a heavy rain. Another problem with a thin layer of sand is that the sand will at least partly run off the generally relatively steep side slopes of the bunker.

A solution to the problem is to use a water permeable fabric as a liner that is applied on the ground/soil before the application of the bunker sand. However, there are several problems when using such a fabric. For instance, when a golf player is hitting the ball in a bunker he may also hit the underlying fabric, hence there is a risk that the fabric will move in relation to the sand and the soil. Such a movement may result in that the fabric will be visible by sticking up out of the sand. In addition, the players by mistake hitting the fabric, results in that the fabric will be worn out and break up. Thus, the fabric needs to be changed. An average lifetime of a fabric is about five to seven years. The problems with movements of the fabric are even larger in regions where the ground will freeze during winters, since the freezing of the ground increases the risk of movements of the fabric, and thus also the risk of exposure of the fabric to golf shots.

A solution to the problem is disclosed in WO2007070913, in which a base for a playing field is disclosed. The base for a playing field may be used for golf bunkers and comprises a layer of particulate material, said layer forming at least an upper part of the base, and a binder applied to the layer of particulate material, the binder extending from about 5 mm to about 150 mm into the layer of particulate material, the binder acting to bind at least the uppermost part of the layer of particulate material, said layer being porous to water such that water applied to a surface of the base flows through said layer. However, it has turned out that there are several problems with such a base for a playing field. One problem is formation of cracks. That is, when the base is exposed for water during long periods, such as during rainy periods in Nordic countries, the base will first become soft and thereafter crack. Moreover, the binder of the base is difficult to apply to the surface and setting of the binder is troublesome, since for best possible setting of the base it is preferable that the base is not exposed to water during setting. This may be difficult to achieve, since the total time before the base is completely set is about 7 days. Still another problem is that the lifetime of the base is not satisfying.

Hence, there is a need for improved methods for foundation of golf bunkers, and more specifically that overcomes or at least alleviates the prior art problems of golf bunker bases or liners.

SUMMARY OF THE INVENTION

In view of the above-mentioned and other drawbacks of the prior art, a general object of the present invention is to alleviate said drawbacks. According to a first aspect of the invention a method for foundation of a sports area is provided. The method comprises the steps of providing a first mixture of cement and particulate stone material; mixing said first mixture with a predetermined amount of water for forming a second mixture; applying a layer of said second mixture to a surface located at the place where the sports area is intended to be situated; curing/setting said layer of said second mixture applied to the surface, wherein the cured layer is porous and allows water to flow through said cured layer; and applying a layer of a particle size fraction onto said cured layer after the step of curing.

Curing or setting is intended to have its ordinary meaning in the context, that is, the process of the layer of the second mixture to harden due to chemical reactions in the layer. Particle size fraction or particle fraction is intended to mean some type of particulate stone material, such sand, gravel or the like.

Such a method is advantageous, since the second mixture is easy to apply or spread out onto the surface of the desired area. In addition, the resulting sports area comprises a strong and porous layer, which is draining and allows thus water to flow through it. Thus, the risk for water accumulation on the sports area is decreased. Also, although such a layer is provided with a suitable porosity, it may still be subjected to periods of flooding. The inventive layer is designed to better withstand such conditions. Frost is another condition which the inventive layer is better suited than earlier known layers. Since the cured layer is between the soil and the particle fraction, e.g. sand, the problem with contamination of the particle fraction with soil is solved. Further, the cured layer may be exposed for water during long periods, for instance due to rain, without giving rise to problems with cracking. In addition, the method according to the invention facilitates foundation of sports areas, increases the lifetime of sports areas and is more cost efficient than prior art methods.

In an exemplary embodiment, said surface is a surface of a depression surrounded by a grass area on a golf course. Naturally, the surface may be some other depression, for instance a surface intended to be a ground for beach volleyball or equestrian sand school. The surface may alternatively be a surface of an elevation of ground or a plain ground. Evidently, the surface need not to be smooth or horizontal, but may be sloping or even bumpy.

Especially, a method for foundation of a golf bunker is provided. The method comprises the steps of: providing a first mixture of cement and particulate stone material; mixing said first mixture with a predetermined amount of water for forming a second mixture; applying a layer of said second mixture to a surface of a depression surrounded by a grass area on a golf course; and curing/setting said layer of said second mixture applied to the surface of said depression, wherein the cured layer is porous and allows water to flow through said layer.

Such a porous layer is advantageous, since it prevents contamination of sand, for instance in a golf bunker, and allows at the same time draining of a bunker since the water may flow through said layer. In addition, the lifetime of such a layer is sufficiently long due to the strength of the layer.

In an exemplary embodiment, the method for foundation of a golf bunker further comprises the step of application of a layer of a particle fraction onto said layer after the step of curing.

In an exemplary embodiment, a relation of an average size of particles of said particle fraction and an average size of the particles of said particulate stone material is in range 10-20%, suitably 12-18%, and more suitably 14-15%.

Such a relation of the average sizes of particles of the particle fraction and the particulate stone material is advantageous, since it allows the size of the pores of the cured layer be matched to the size of the pores of the layer of the particle fraction on the cured layer, in order to allow water to flow through both the layer of sand and the cured layer. That is, the resulting relation between the average size of the pores of the cured layer and the particles of the particle fraction will be such that the particles of the particle fraction may not obstruct the pores of the cured layer. In addition, the particles of the particle size fraction will not slip into the pores of the cured layer. Thus, there is no need to refill the sports area with sand after a period due to problem with the sand flowing through the cured layer to the underlying ground. Further, due to the resulting relation between the average sizes of the pores of each layer an advantageous draining capacity of the cured layer in relation to the draining capacity of the layer of the particle fraction is obtained. Thus, a sufficient draining property of the layer is ensured. In addition, such a relation of the average sizes of particles of the particle fraction and the particulate stone material, results in suitable surface roughness of the cured layer that contributes to the particle size fraction on a sloping surface of the cured layer to remain on the intended area better. Especially, for golf bunkers, the particle fraction in form of sand on the side slopes of the bunker will partly lie in the cavities on the surface, and therefore be prevented from running off the side slopes.

In an exemplary embodiment, said first mixture comprises 15-40% by dry weight cement and 60-85% by dry weight particulate stone material, suitably 20-35% by dry weight cement and 65-80% by dry weight particulate stone material, and more suitably 30% by dry weight cement and 70% by dry weight particulate stone material.

Such a mixture is advantageous, since the resulting layer has a strength that is sufficient for ensuring a desirable lifetime of the layer. The strength of the cured layer may relate to both bearing capacity of the cured layer and to surface resistance of the cured layer.

In an exemplary embodiment, said cement is hydraulic cement.

Hydraulic cement is advantageous, since during curing hydraulic cements harden because of hydration chemical reactions that occur independently of the mixture's water content, and they can therefore harden even underwater or when constantly exposed to wet weather.

In an exemplary embodiment, said cement is a Portland cement or blended cement.

A Portland cement is preferable, since such cement often has a color which is sand-like. It is advantageous that the color of the porous layer is as similar to the color of the sand as possible, since it results in that the porous layer will be more unperceivable.

In an exemplary embodiment, an average particle size of said particle size fraction is 0.75 mm.

In an exemplary embodiment, said particle size fraction is sand with particle sizes in range 0.15-1.5 mm.

In an exemplary embodiment, wherein said predetermined amount of water is within the range 6-20% by volume.

The predetermined amount of water added to the mixture depends on the conditions at time of application. Typically, in wet weather, the amount of water added to the mixture is in the lower range and in dry weather, the amount of water added to the mixture is in the higher range. Generally, it is desirable to keep the amount of water as low as possible to achieve the highest possible strength of the cured layer.

In an exemplary embodiment, at least 75% of said particles of said particulate stone material are of sizes within the range 0.1-10 mm.

Particles of sizes within such a range are advantageous, since such a particle size implies that the layer will be porous such that draining is allowed. In addition, the particles are small enough such that the particles that possibly will, during use of the golf bunker, be hit to the surrounding grassy area may not damage lawn mowers or other machines used on the golf course.

In an exemplary embodiment, at least 85% of said particles of said particulate stone material are of sizes within the range of 0.2-8 mm, suitably at least 95% of said particles of said particulate stone material are of sizes within the range 0.5-6 mm.

Such particle sizes are advantageous, since the resulting layer will be sufficiently strong and have sufficient draining properties.

In an exemplary embodiment, maximum 10% of said particles of said particulate stone material are smaller than 3 mm, and suitably maximum 5% of said particles of said particulate stone material are smaller than 2.8 mm. Thus, it is ensured that the cured layer will not be totally water impermeable and that the cured layer comprises enough pores.

In an exemplary embodiment, maximum 10% of said particles of said particulate stone material are smaller than 4.5 mm, and suitably maximum 5% of said particles of said particulate stone material are smaller than 4 mm.

In an exemplary embodiment, said particulate stone material comprises natural stone. Natural stone material or natural stones, is intended to mean stone material that is naturally occurring. Natural stone is advantageous, since for a cured layer having sufficient draining properties, the bonds between the particles of natural stone within such a cured layer are stronger compared to the bonds between the particles of crushed aggregate within such a cured layer.

In an exemplary embodiment, said particulate stone material comprises crushed aggregate.

In an exemplary embodiment, the method further comprises the step of inserting a drip line into the applied layer of said second mixture before said step of curing/setting said layer. The porous applied layer will allow liquid, such as water, from the embedded drip line to spread by means of capillary forces. Thus, the liquid may even be distributed to another layer, e.g. a layer of particulate material, such as sand, arranged on top of said applied layer of said second mixture. This may be particularly advantageous for a sports area in the form of a golf bunker. With this construction, the sand of the golf bunker will be kept moist by the moisture emanating from the drip line. Moist sand is more compact than dry sand and is therefore less likely to move, thus better at maintaining the bunker intact.

In an exemplary embodiment, said drip line is inserted into a peripheral area or areas of the applied layer of said second mixture. Suitably, the dripline may be arranged along most of or the entire circumference of the applied layer.

According to another aspect of the invention, there is provided a mixture for foundation of a sports area. The mixture comprises cement and particulate stone material, wherein said mixture comprises ca. 15-40% by dry weight cement and 60-85% by dry weight particulate stone material, suitably 20-35% by dry weight cement and 65-80% by dry weight particulate stone material, and more suitably 30% by dry weight cement and 70% by dry weight particulate stone material, and wherein at least 75% of said particles of said particulate stone material are of sizes within the range 0.1-10 mm.

Such a mixture is advantageous since it results in a strong and porous layer, which facilitates the draining properties of the sports area. Further, the advantages of the mixture are analogous to the advantages of the method.

In an exemplary embodiment, at least 85% of said particles of said particulate stone material are of sizes within the range of 0.2-8 mm, suitably at least 95% of said particles of said particulate stone material are of sizes within the range 0.5-6 mm.

In an exemplary embodiment, maximum 10% of said particles of said particulate stone material are smaller than 3 mm, and suitably maximum 5% of said particles of said particulate stone material are smaller than 2.8 mm.

In an exemplary embodiment, maximum 10% of said particles of said particulate stone material are smaller than 4.5 mm, and suitably maximum 5% of said particles of said particulate stone material are smaller than 4 mm.

In an exemplary embodiment, said particulate stone material comprises natural stones.

In an exemplary embodiment, said particulate stone material comprises crushed aggregate.

In an exemplary embodiment, said cement is hydraulic cement.

In an exemplary embodiment, said cement is a Portland cement or blended cement.

The advantages of the mixture are analogous to the advantages discussed in connection with the first aspect of the invention, and the embodiments thereof.

According to a third aspect of the invention, a method for foundation of a sports area, such as a golf bunker is provided. The method comprising the steps of:

applying a first layer of a material or a mixture of material to a surface located at the place where the sports area is intended to be situated;

inserting a drip line said applied layer, curing/setting said applied layer containing the inserted drip line.

According to a fourth aspect of the invention, a sports area, such as a golf bunker, is provided. The sports area comprises:

a first layer which has been cured/set on a ground, the first layer containing a drip line, a second layer of a particulate size fraction located vertically on top of said first layer, wherein liquid emerging from the drip line is by capillary forces transported via the first layer to the second layer.

For instance, if said second layer is sand in a golf bunker, it will be kept moist by means of the moisture emanating from the drip line and transported via the first layer to the sand by means of capillary forces. Thus, it should be understood, that any material or mixture of material having a pore size dimensioned for exerting capillary forces on a liquid may be used as said first layer.

Thus, according to the third and fourth aspects of the invention, the drip line can be inserted into any suitable material or mixture of material. Although the third and fourth aspects of the invention are not limited to any particular material, it should be understood that the features, materials, mixtures, steps and functions, etc. discussed above in connection with the method and mixture of the first and second aspects of the invention, may suitably also be incorporated in exemplary embodiments of the third and fourth aspects of the invention.

According to another aspect of the invention, there is provided a sports area. The sports area comprises a first layer which is cured on a ground, and a second layer of a particulate size fraction located vertically on top of said first layer. Said first and second layers are provided according to a method according to the first aspect of the invention.

In an exemplary embodiment, said sports area is a golf bunker, and said second layer of a particulate size fraction comprises sand.

The advantages of the sports area are analogous to the advantages discussed in connection with the first aspect of the invention, and the embodiments thereof.

Further features of, and advantages with, the present invention will become apparent when studying the appended claims and the following description. The skilled addressee realizes that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION OF EXEMPLARY EMBODIMENTS

Figure 1:
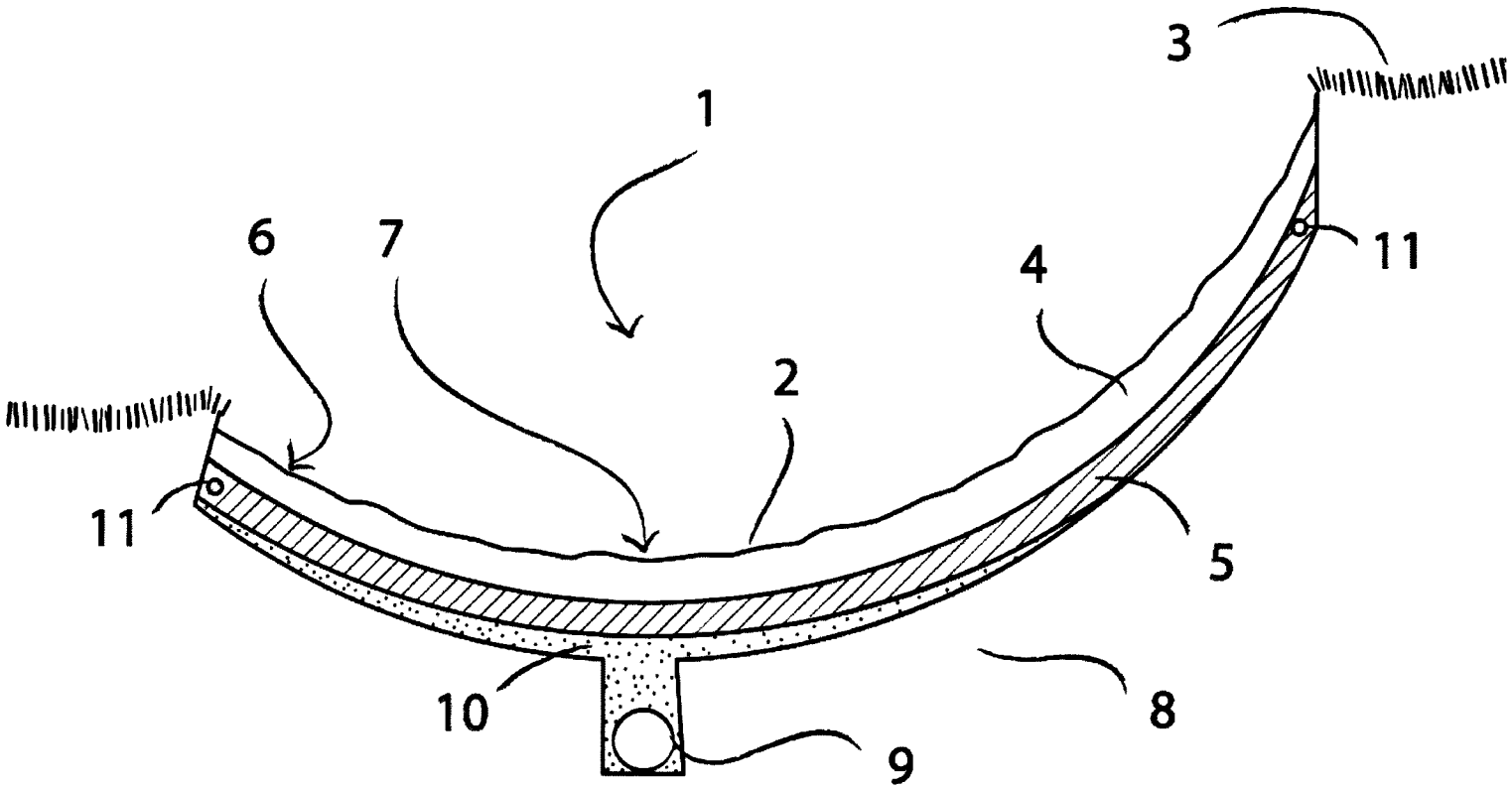
FIG. 1 is a schematic illustration of an exemplary golf bunker resulting according to the inventive method.

The invention relates to a method for foundation of a sports area. A sports area may be a depression intended as a golf bunker on a golf course, a ground intended for beach volleyball, beach soccer, beach tennis, speedminton, or the like, or an area intended for boules, or the like. Alternatively, a sports area may be an equestrian or another sports area where contamination of sand or other particle size fractions is a problem.

In an exemplary method according to the invention, a first mixture of cement and particulate stone material is provided. The first mixture comprises suitably 15-40% by dry weight cement and 60-85% by dry weight particulate stone material. The particles of particulate stone material are of sizes of slightly above 2 mm to about 6 mm, and about 75% of the particles are of sizes within the range of 2.8-4 mm. Maximum 10% of said particles are smaller than 3 mm, and suitably maximum 5% of said particles are smaller than 2.8 mm.

In another exemplary method according to the invention, the particles of particulate stone material are of sizes of about 2.8-8 mm, and about 95% of the particles are of sizes within the range of 4-8 mm. Maximum 10% of said particles of said particulate stone material are smaller than 4.5 mm, and suitably maximum 5% of said particles of said particulate stone material are smaller than 4 mm.

In yet another exemplary method according to the invention, the first mixture comprises suitably 30% by dry weight cement and 70% by dry weight particulate stone material. An average size of particles of the particulate stone material is in the range 1-2 mm. Suitably, said particulate stone material comprises maximum 0.5% of particles of a size smaller than 0.125 mm, 2% by dry weight of particles within the size range 0.2-0.6 mm, 24% by dry weight of particles within the size range 0.6-1 mm, 51% by dry weight of particles within the size range 1-2 mm, 23% of particles within the size range 2-4 mm, and 0% of particles within the size range 4-5.6 mm.

The particulate stone material and the cement may be mixed to the first mixture at some kind of production factory or at the site where the sports area is located.

The particulate stone material may comprise natural stone material, or natural stones, that is, the particulate stone material may comprise stone material that is naturally occurring.

The first mixture is mixed with a predetermined amount of water for forming a second mixture in form of a paste which may be applied on a surface of a desired area, which is suitable for the intended application. The amount of water is preferably in range 6-20% by volume and depends on the ambient conditions. If the first mixture is mixed at the site where the sports area is located the particulate stone material may comprise small amounts water, which the person founding the sports area has to consider when mixing water to the first mixture. In such a case a smaller amount of water may be preferable.

The paste is applied on a surface of earth, soil, clay, gravel, crushed stone or the like. However, it is suitable that the material on which the paste, that is the mixture of cement, particulate stone material and water, is to be applied is compact or compressed, such that it will not settle after foundation, since settling may cause the porous layer to crack. For forming a liner for a golf bunker, a layer of the paste is applied to a surface of a depression on a golf course. After a layer of desired or suitable thickness is spread on the desired surface, the layer is cured or set. The thickness of the layer may vary depending on the application. Generally the layer is in range 2-20 cm. After curing, a cured porous layer is formed which is draining and thus allows water to flow through said cured layer.

After the step of curing, a layer of a particle size fraction, in an exemplary embodiment in form of a sand layer, is applied directly onto said cured layer. Such that the particles of the particle size fraction are in contact with the surface of the cured porous layer. Suitably, an average size of particles of said particle fraction is in range 25-50% of an average size of the pores of the layer. An average size of a major part of the particles of the particulate stone material of the mixture is suitably 7 times larger than an average size of particles of said particle size fraction. Said particle size fraction may be in form of fine sand, medium sand, coarse sand, gravel, or the like. A suitable size of the particles of the particle size fraction may vary depending on the application.

The cement in the first mixture is advantageously Portland cement, which is hydraulic cement. Hydraulic cements are advantageous, since they harden because of hydration chemical reactions that occur independently of the admixture's water content. Thus, hydraulic cements can harden even underwater or when constantly exposed to wet weather. Generally, cement is soluble in water and not water absorbent. Portland cement is preferable since the color of Portland cement is often similar to the color of the sand that is used in for instance golf bunkers. Alternatively, other types of cement may be used, such as blended hydraulic cement or expansive cement. Such cements may be used in combination with a polymer or a pigment such that a desired color is obtained. Still other types of cements may also be suitable.

It may be advantageous to add pigment to the mixture for obtaining a color of the porous layer that for some reason is more preferred than another color. In addition, the color of the cement may vary depending on the constituents. By using pigments, the color of the cured layer can be affected such that it will match the color of the particle fraction or the sand that is applied onto the cured layer. Due to color variations of the cement different pigments may be added to the mixture such that the color of the resulting porous layer is as desired. Alternatively, a specially colored Portland cement may be used for obtaining a cured layer with a color that matches the color of the particle fraction.

FIG. 1 is a schematic illustration of an exemplary sports area 1 in form of a golf bunker founded according to the method according to the invention. The golf bunker 1 in the figure is a depression 2 surrounded by a grass area 3 on a golf course. The golf bunker 1 comprises a porous cured layer 5 applied on the ground 8. The golf bunker 1 further comprises a sand layer 4 applied on the cured porous layer 5 such that the particles of the sand are in direct contact with the porous layer 5. The thickness of the porous layer 5 is advantageously in the range 2-20 cm. Depending on the application and surrounding circumstances, the thickness of the cured porous layer 5 may vary. For instance, if the ground on which the porous layer is applied itself is porous a thinner layer can provide required draining properties. On the contrary, if the ground itself is almost water permeable, a thicker layer may be required for obtaining the desired or sufficient draining properties. Further, different applications can require porous layers 5 of different thicknesses. That is, for instance an area intended for horse riding may require a thicker porous layer 5 than an area intended for boules, since the force applied on the cured porous layer 5 by horses and riders probably is larger than the force applied by the boules players and their balls.

The golf bunker 1 in FIG. 1 is provided with a draining pipe 9 at the deepest or lowest area 7 of the bunker. The draining pipe 9 is surrounded by draining gravel 10 having an average particle size known by a person skilled in the art. Alternatively, a fabric may be applied between the pipe 9 and the gravel 10 for preventing obstruction of the holes of the pipe 9.

A drip line 11 is arranged at an upper area 6 of the bunker along the circumference of the porous layer 5. The drip line 11 has been embedded in the porous layer 5 before the layer is cured/set. The drip line 11 may, for instance, be in the form of a tube supplied with water, and having a plurality of apertures along its extension. Water will leak from to the porous layer 5. Due to capillary forces, the moisture will be drawn up to the sand layer 4, which can be kept at moist. This is advantageous since the moist sand is less likely to move and will thus more easily keep the golf bunker 1 intact. It should be understood that, while the drip line 11 is advantageously used to keep the sand layer 4 sufficiently moist, the draining pipe 9 is present to avoid too much water accumulating in the bunker, e.g. due to heavy rain.

Figure 2:
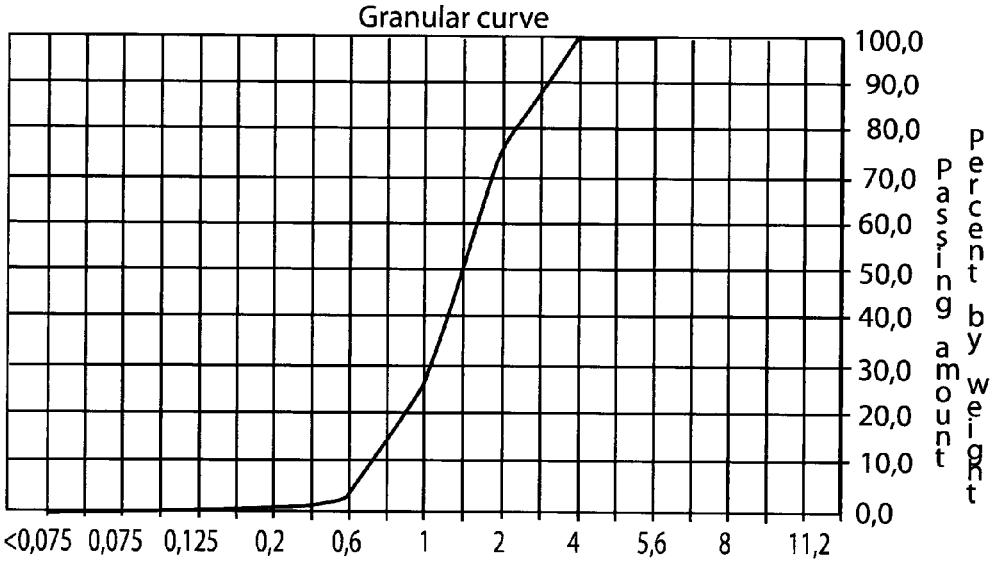
FIG. 2 is a granular curve for an exemplary particulate stone material used in a mixture according to the invention.

FIG. 2 is a granular curve for an exemplary particulate stone material of natural stone used in a mixture according to the invention. In this example embodiment particles of particulate stone material are of sizes of 0.2-4 mm, and at least 95% of the particles are of sizes within the range of 0.6-2 mm. A particulate stone material according to the granular curve is advantageous since it results in a porous layer with a suitable porosity. That is, such a layer has an average pore size that ensures that the layer has the requested draining properties while the pore size is advantageous relative to the average size of particles of sand that is generally used for sports areas and especially for golf bunkers. Thus, the draining properties of the layer are ensured.

Figure 3:
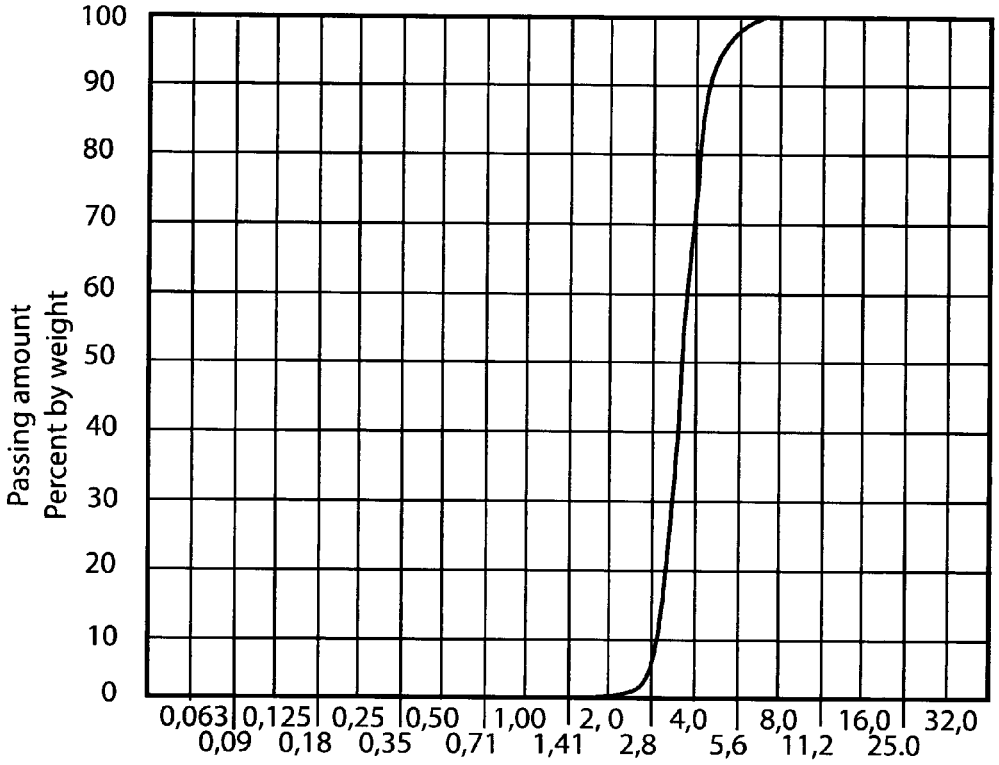
FIG. 3 is a granular curve for another exemplary particulate stone material used in a mixture according to the invention.

FIG. 3 is a granular curve for another exemplary particulate stone material used in a mixture according to the invention. In this example embodiment particles of particulate stone material are of sizes of slightly above 2 mm to about 6 mm, and about 75% of the particles are of sizes within the range of 2.8-4 mm. Maximum 10% of said particles are smaller than 3 mm, and suitably maximum 5% of said particles are smaller than 2.8 mm.

Figure 4:
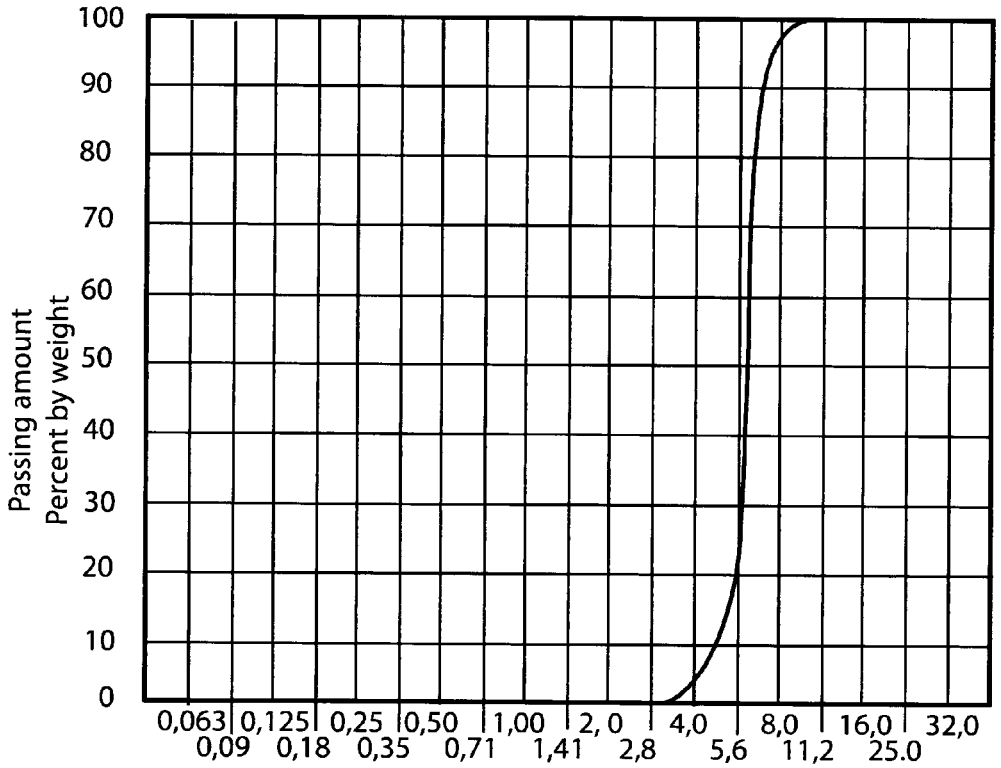
FIG. 4 is a granular curve for yet another exemplary particulate stone material used in a mixture according to the invention.

FIG. 4 is a granular curve for yet another exemplary particulate stone material used in a mixture according to the invention. In this example embodiment particles of particulate stone material are of sizes of about 2.8-8 mm, and about 95% of the particles are of sizes within the range of 4-8 mm. Maximum 10% of said particles of said particulate stone material are smaller than 4.5 mm, and suitably maximum 5% of said particles of said particulate stone material are smaller than 4 mm.

It should be understood that the specified maximum percentages above are not limited to embodiments having the illustrated granular curves in FIGS. 3 and 4. On the contrary, these maximum percentages may be present for embodiments having other granular curves as well. Similarly the ranges described in connection with FIGS. 3 and 4 are not limited to just those specific embodiments. There are other conceivable embodiments having different granular curves for which said ranges may still be valid.

Thus, FIGS. 2-4 have illustrated that there may be different sizes and size distributions of particulate stone material in the mixture for a foundation of a sports area. When planning for a foundation of a sports area, such as a golf bunker, different factors may influence the choice of sizes of the particulate stone material. One such factor is what type of sand or other material is to be placed on top of the foundation of the sports area. For instance, for coarse sand a relatively larger size of particulate stone material would be appropriate. In contrast, for fine sand it would be appropriate to choose a relatively small size of particulate material in order to reduce the risk of sand clogging the pores of the foundation. Other factors may be the expected weather conditions at the site and cost aspects.

Even though the invention has been described with reference to specific exemplifying embodiments thereof, many different alterations, modifications and the like will become apparent for those skilled in the art. For example, the particulate stone material may be a crushed aggregate instead of being natural stone, or fabric may be arranged between the cured layer and the particle size fraction if it is suitable. In addition, the cured layer may comprise reinforcement, for instance of composite.

In an alternative embodiment, instead of being mixed with water before application, the mixture of cement and particulate stone material may be applied on the surface of the area that is to be covered. Thereafter, a predetermined amount of water is applied to said layer of mixture for activating said cement, and subsequent curing/setting of said second mixture applied to the surface will take place. After curing, sand is applied to the cured porous layer. Still alternatively, particulate stone material may be applied on the surface of the area that is to be covered. Thereafter, a predetermined amount of water mixed with cement is applied to said layer of particulate stone material, and subsequent curing/setting of said second mixture applied to the surface will take place. After curing, sand is applied to the cured porous layer.

The invention claimed is:

1. A method for foundation of a sports area, the method comprising:

providing a first mixture of cement and particulate stone material;

mixing said first mixture with a predetermined amount of water for forming a second mixture;

applying a first layer of said second mixture to a surface located at the place where the sports area is intended to be situated;

curing/setting said layer of said second mixture applied to the surface, wherein the cured layer is porous and allows water to flow through said cured layer; and applying a second layer of a particle size fraction onto said cured layer after the step of curing.

2. The method of claim 1, wherein said surface is a surface of a depression surrounded by a grass area on a golf course.

3. The method of claim 1, wherein a relation of an average size of particles of said particle fraction and an average size of the particles of said particulate stone material is in range 10-20%.

4. The method of claim 1, wherein said first mixture comprises 15-40% by dry weight cement and 60-85% by dry weight particulate stone material.

5. The method of claim 1, wherein said cement is hydraulic cement.

6. The method of claim 5, wherein said cement is a Portland cement or blended cement.

7. The method of claim 1, wherein an average particle size of said particle fraction is 0.75 mm.

8. The method of claim 1, wherein said particle size fraction is sand with particle sizes in range 0.15-1.5 mm.

9. The method of claim 1, wherein said predetermined amount of water is within the range 6-20% by volume.

10. The method of claim 1, wherein at least 75% of said particles of said particulate stone material are of sizes within the range 0.1-10 mm.

11. The method of claim 1, wherein at least 85% of said particles of said particulate stone material are of sizes within the range of 0.2-8 mm.

12. The method of claim 1, wherein maximum 10% of said particles of said particulate stone material are smaller than 3 mm.

13. The method of claim 1, wherein maximum 10% of said particles of said particulate stone material are smaller than 4.5 mm.

14. The method of claim 1, wherein said particulate stone material comprises natural stone.

15. The method of claim 1, wherein said particulate stone material comprises crushed aggregate.

16. The method of claim 1, further comprising inserting a drip line into the applied layer of said second mixture before said curing/setting said layer.

17. The method of claim 16, wherein said drip line is inserted into a peripheral area or areas of the applied layer of said second mixture.

18. The method of claim 1, wherein applying the second layer of a particle size fraction onto said cured layer includes applying the second layer as the topmost layer.

19. A method for foundation of a golf bunker, the method comprising:

providing a first mixture of cement and particulate stone material;

mixing said first mixture with a predetermined amount of water for forming a second mixture;

applying a layer of said second mixture to a surface of a depression surrounded by a grass area on a golf course; and curing/setting said layer of said second mixture applied to the surface of said depression, wherein the cured layer is porous and allows water to flow through said layer.

20. The method of claim 19, further comprising applying a layer of a particle fraction onto said layer after the curing.

21. The method of claim 20, wherein applying the layer of a particle fraction onto said cured layer includes applying the layer as the topmost layer.

22. A mixture for foundation of a sports area, the mixture comprising cement and particulate stone material, wherein said mixture comprises ca.15-40% by dry weight cement and 60-85% by dry weight particulate stone material, and wherein at least 75% of said particles of said particulate stone material are of sizes within the range 0.1-10 mm.

23. The mixture of claim 22, wherein at least 85% of said particles of said particulate stone material are of sizes within the range of 0.2-8 mm.

24. The mixture of claim 22, wherein maximum 10% of said particles of said particulate stone material are smaller than 3 mm.

25. The mixture of claim 22, wherein maximum 10% of said particles of said particulate stone material are smaller than 4.5 mm.

26. The mixture of claim 22, wherein said particulate stone material comprises natural stones.

27. The mixture of claim 22, wherein said particulate stone material comprises crushed aggregate.

28. The mixture of claim 22, wherein said cement is hydraulic cement.

29. The mixture of claim 28, wherein said cement is a Portland cement or blended cement.

30. A method for foundation of a sports area, the method comprising:

applying a first layer of a material or a mixture of material to a surface located at the place where in the sports arena is intended to be situated;

inserting a drip line in said applied layer;

curing/setting said applied layer containing the inserted drip line.

31. The method of claim 30, wherein the inserting comprises inserting the drip line into a peripheral area or areas of the applied layer.

32. A sports area, comprising:

a first layer which has been cured/set on a ground, the first layer containing a drip line; and a second layer of a particulate size fraction located vertically on top of said first layer, wherein liquid emerging from the drip line is by capillary forces transported via the first layer to the second layer.

33. The sports area of claim 32, wherein the second layer is the topmost layer.

34. A sports area, comprising:

a first layer which has been cured/set on a ground, the first layer containing a drip line; and a second layer of a particulate size fraction located vertically on top of said first layer, wherein liquid emerging from the drip line is by capillary forces transported via the first layer to the second layer, wherein said first and second layers are provided according to the method of claim 1.

35. A sports area comprising a first layer which is cured on a ground, and a second layer of a particulate size fraction located vertically on top of said first layer, wherein said first and second layers are provided according to the method of claim 1.

36. The sports area of claim 35, wherein said sports area is a golf bunker, and said second layer of a particulate size fraction comprises sand.

* * * * *